US007815049B2

(12) United States Patent
Hiramoto et al.

(10) Patent No.: US 7,815,049 B2
(45) Date of Patent: Oct. 19, 2010

(54) PACKING FILLER FOR CONTAINER

(75) Inventors: Shinji Hiramoto, Hyogo (JP); Yasuyuki Shiraishi, Chiba (JP); Kenji Ohnishi, Osaka (JP); Kouichi Yoshimi, Osaka (JP)

(73) Assignee: Shionogi & Co., Ltd. (JP)

( * ) Notice: Subject to any disclaimer, the term of this patent is extended or adjusted under 35 U.S.C. 154(b) by 0 days.

(21) Appl. No.: 12/087,828

(22) PCT Filed: Jan. 19, 2007

(86) PCT No.: PCT/JP2007/050770

§ 371 (c)(1),
(2), (4) Date: Jul. 16, 2008

(87) PCT Pub. No.: WO2007/086319

PCT Pub. Date: Aug. 2, 2007

(65) Prior Publication Data

US 2009/0078608 A1 Mar. 26, 2009

(30) Foreign Application Priority Data

Jan. 24, 2006 (JP) ..... 2006-015326

(51) Int. Cl.

| | |
|---|---|
| ***B65D 39/00*** | (2006.01) |
| ***B65D 51/20*** | (2006.01) |
| ***B65D 81/02*** | (2006.01) |
| ***B65D 85/42*** | (2006.01) |

(52) U.S. Cl. ..... 206/521; 215/231; 206/540; 206/814

(58) Field of Classification Search ..... 206/521, 206/540, 592, 594, 814; 215/231, 246
See application file for complete search history.

(56) References Cited

U.S. PATENT DOCUMENTS

| | | | | |
|---|---|---|---|---|
| 2,884,149 | A * | 4/1959 | Zimmermann et al. | 215/231 |
| 2,937,745 | A * | 5/1960 | Wilson | 215/231 |
| 3,033,409 | A * | 5/1962 | Lind | 206/540 |
| 6,619,494 | B1 * | 9/2003 | Brozell et al. | 206/814 |

FOREIGN PATENT DOCUMENTS

| | | |
|---|---|---|
| JP | 5-7151 | 2/1995 |
| JP | 7-25307 | 6/1995 |
| JP | 2003-40335 | 2/2003 |

* cited by examiner

*Primary Examiner*—J. Gregory Pickett
*Assistant Examiner*—Kaushikkumar Desai
(74) *Attorney, Agent, or Firm*—Wood, Phillips, Katz, Clark & Mortimer

(57) ABSTRACT

A container packing filler includes an annular roll portion formed by folding one of axially opposite end portions of a stretchable tubular net radially outward and rolling the net toward the other end portion of the net, and a rigid holder portion provided at the other end portion of the net. The holder portion has sufficient axial length and a width greater than the diameter of a center hole of the annular roll portion so that, when the holder portion of the packing filler is squeezed into the center hole of the annular roll portion, the annular roll portion is expanded from the inside thereof by the holder portion and layers of the annular roll portion are unitarily rolled inward.

7 Claims, 5 Drawing Sheets

PRIOR ART

PRIOR ART

PACKING FILLER FOR CONTAINER

TECHNICAL FIELD

The present invention relates to a container packing filler to be filled as a cushioning material in an upper space of a package container such as a glass bottle or a plastic bottle which contains a multiplicity of solid pieces such as tablets or capsules.

BACKGROUND ART

The inventors of the present invention have already disclosed a prior-art packing filler of the aforesaid type in Patent Document 1.

Patent Document 1: JP-A-2003-40335

As shown in FIGS. 5 and 6, the prior-art packing filler is a body formed from a tubular resilient net material 22 having opposite end portions one of which is open and the other of which is defined as a bound portion 21. The packing filler includes an annular roll portion 23 formed by folding the open end portion outward and rolling up the net material 22 toward the bound portion 21. The bound portion of the prior-art packing filler is formed by fusion-bonding the other end portion of the net into a flat disk shape.

The bound portion 21 of the prior-art packing filler projects above the annular roll portion 23 before the packing filler is filled in an upper space of a container. The packing filler can be easily squeezed into the container by holding the bound portion 21. However, when a cap is attached to the container, the bound portion 21 is depressed by the cap as shown in FIG. 7, whereby only the outermost layer 24 of the annular roll portion 23 is correspondingly bulged to be slacked. With only the outermost layer 24 thus bulged, a cushioning effect for tablets contained in the container is significantly reduced. Further, the tablets are likely to enter a center net portion of the bulged outermost layer 24. Therefore, when the packing filler is removed from the container, the tablets are likely to be inadvertently taken out together with the packing filler and scattered on a floor. If the outermost layer 24 is bulged upward as well as downward when the bound portion 21 is depressed, the bulged net portion is likely to be caught between a container mouth and the cap attached to the container.

DISCLOSURE OF THE INVENTION

It is therefore an object of the present invention to provide a packing filler which is arranged to prevent the bulging of only the outermost layer of the annular roll portion.

The inventive container packing filler includes an annular roll portion formed by folding one of axially opposite end portions of a stretchable tubular net radially outward and rolling the net toward the other end portion of the net, and a rigid holder portion provided at the other end portion of the net to be squeezed into a center hole of the annular roll portion, wherein the holder portion has a maximum width which is greater than a diameter of the center hole of the annular roll portion. According to the present invention, the rigid holder portion has a predetermined width and a predetermined axial length, whereby the annular roll portion is expanded from the inside thereof by the holder portion when the holder portion is squeezed into the center portion of the annular roll portion. Thus, frictional resistance occurring between respective layers of the annular roll portion is increased. Further, the entire annular roll portion is deformed due to the squeezing of the holder portion, and more tightly rolled. That is, the holder portion has a wedge-like function, thereby preventing the bulging of only the outermost layer of the annular roll portion.

The holder portion of the inventive packing filler may be a part of the other end portion of the net bound by fusion-bonding as having a predetermined axial length and a predetermined shape. Alternatively, the holder portion may be a part of the other end portion bound with the use of an adhesive and with or without fusion-bonding. Further, a member separate from the net may be attached to the other end portion of the net. The holder portion preferably has hardness sufficient to deform the annular roll portion against the resilience of the annular roll portion. Where the member separate from the net is composed of a resin having a moisture absorbing function (e.g., available under the trade name of DRY KEEP), the internal humidity of the container can be effectively controlled.

The holder portion preferably has a noncircular cross section, such as a planar shape, a crossed cross section, a V-shaped cross section, a W-shaped cross section or an open square cross section, having a predetermined width and a predetermined axial length. With this arrangement, when the holder portion is squeezed into the center portion of the annular roll portion, the annular roll portion is distorted and deformed at a plurality of positions on its periphery. Thus, the respective layers are further unified to reliably prevent the bulging of the outermost layer alone. Since an upper end face of the holder portion is brought into face contact with a ceiling surface of a cap or into point contact with a plurality of points (preferably three or more points) on the ceiling surface of the cap, the holder portion is less liable to topple when being depressed by the ceiling surface of the cap.

The axial length of the holder portion may be smaller than the axial length of the annular roll portion. With this arrangement, when the holder portion is squeezed into the center hole of the annular roll portion to an extent such that the upper end face of the holder portion is flush with an upper end of the annular roll portion, a lower hole portion of the annular roll portion adjacent to a lower end is narrowed. Thus, tablets are more reliably prevented from entering the lower hole portion. The axial length of the holder portion is preferably greater than one fifth, more preferably one fourth, further more preferably one third, the axial length of the annular roll portion.

According to the present invention, even if the holder portion is squeezed into the center portion of the annular roll portion, the bulging of the outermost layer alone is prevented. As a result, the packing filler has a sufficient cushioning effect, and prevents the tablets from inadvertently falling out of the container. Since the annular roll portion is drawn inward by the wedge effect of the holder portion, it is possible to eliminate the bulge and the slack of the outermost layer to provide a tightening effect.

BEST MODE FOR CARRYING OUT THE INVENTION

An embodiment of the present invention will hereinafter be described with reference to the attached drawings.

Figure 1:
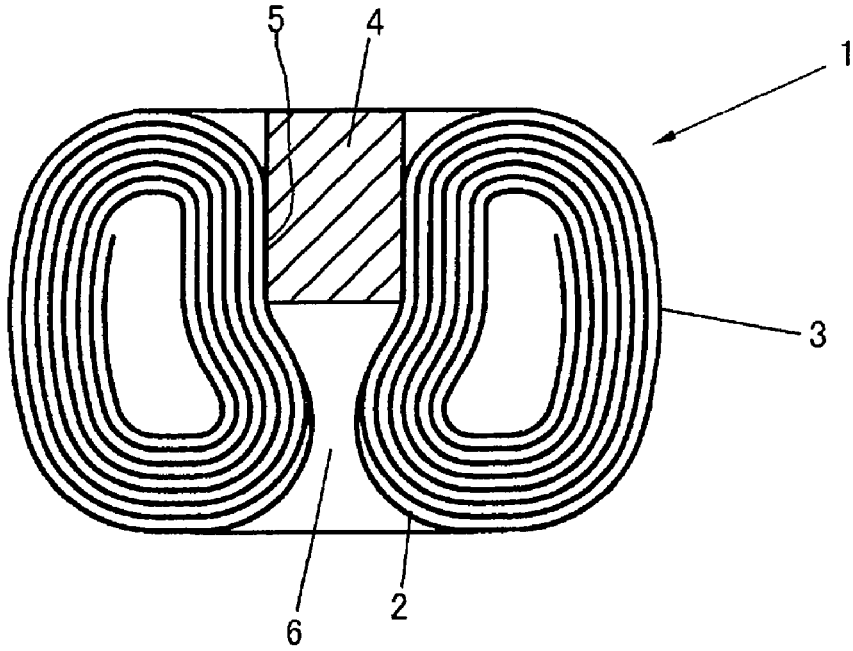
FIG. 1 is a vertical sectional view illustrating a packing filler in use according to one embodiment of the present invention.
Figure 2:
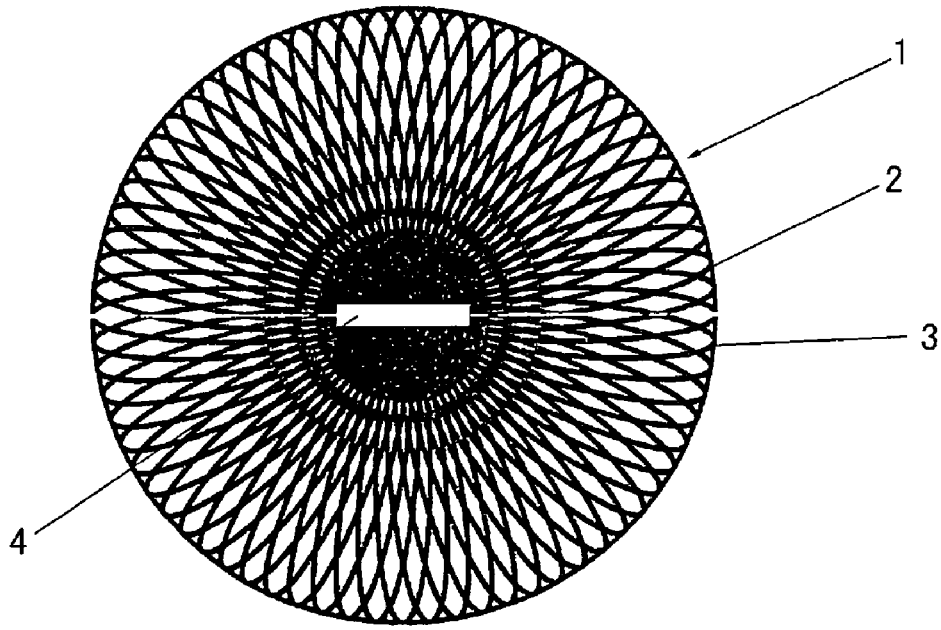
FIG. 2 is a plan view of the packing filler.
Figure 3:
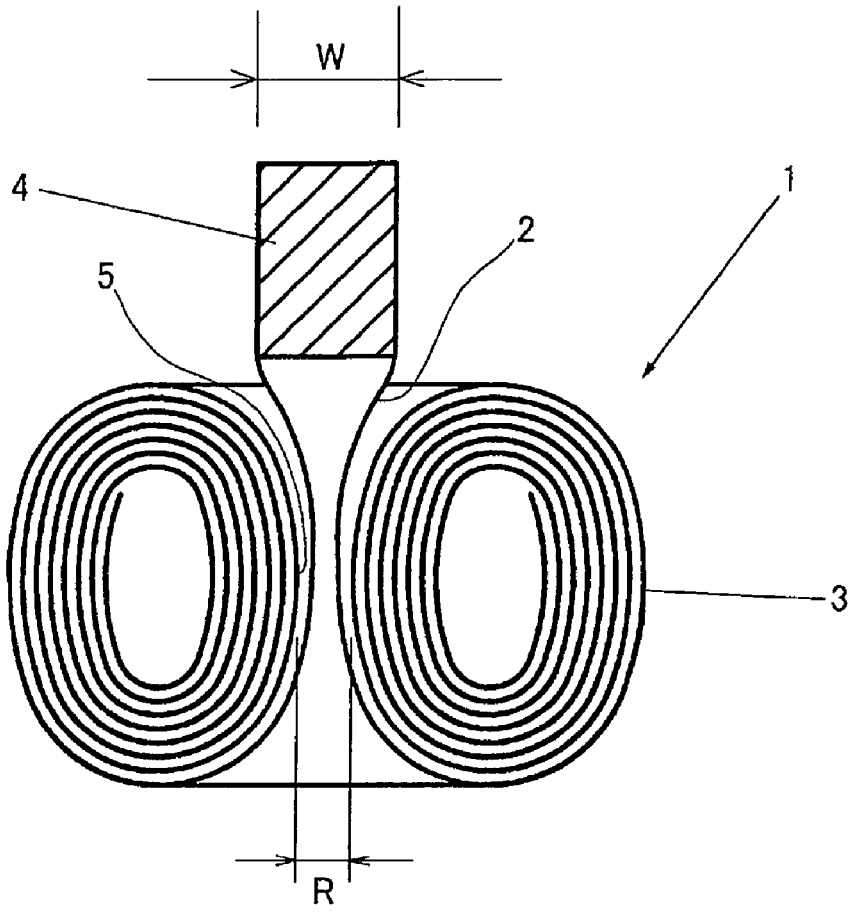
FIG. 3 is a vertical sectional view of the packing filler.

FIGS. 1 to 3 illustrate a container packing filler 1 according to the embodiment of the present invention. The packing filler 1 is filled in an upper space of a container which contains a multiplicity of solid pieces such as tablets or capsules, thereby functioning as a cushioning material for the multiplicity of solid pieces. The packing filler 1 has the same basic construction as that disclosed in JP-A-2003-40335.

The packing filler 1 according to this embodiment includes an annular roll portion 3 formed by folding one of axially opposite end portions of a stretchable and resilient tubular plastic net 2 radially outward and rolling the net 2 toward the other end portion of the net 2, and a rigid holder portion 4 provided at the other end portion of the net 2. Before the packing filler 1 is filled in the upper space of the container, the holder portion 4 projects above the annular roll portion 3 as shown in FIG. 3. When a cap is attached to the container after the packing filler 1 is filled in the container, the holder portion 4 is squeezed into a center hole 5 of the annular roll portion 3 by a top plate of the cap to an extent such that an upper edge of the holder portion 4 is flush with an upper end of the annular roll portion 3 as shown in FIG. 1.

The holder portion 4 is formed by binding and fusion-bonding a part of the other end portion (an upper end portion in FIG. 1) of the tubular net 2 having a predetermined axial length so that the other end portion has a predetermined shape and a predetermined size. In this embodiment, the holder portion 4 has a planar shape. The holder portion 4 has an axial length which is about one half the axial length of the annular roll portion 3 observed when the holder portion 4 is not squeezed into the center hole 5, and a maximum width W which is 1.5 to 3 times the diameter R of the center hole 5 of the annular roll portion 3. The axial length of the holder portion 4 is defined as the axial length of a portion having hardness and width which are sufficient to provide the effects of the present invention. The axial length of the annular roll portion 3 is defined as the height of the annular roll portion 3.

When the holder portion 4 of the packing filler 1 according to this embodiment is squeezed into the center hole 5 of the annular roll portion 3 by the top plate of the cap of the container, so that the tops of the holder portion 4 and annular roll portion are flush with each other, as shown in FIG. 1, the annular roll portion 3 is expanded from the inside thereof at two positions of the planar holder portion 4. Thus, layers of the annular roll portion 3 are unitarily rolled inward, so that the bulging of the outermost layer alone is prevented. Since the holder portion 4 merely extends to an axially middle of the annular roll portion 3, the layers of the annular roll portion 3 are bulged radially inward in a lower end portion of the annular roll portion. Therefore, a lower hole portion 6 is narrowed, so that the tablets or the like are effectively prevented from entering the lower hole portion 6.

An ordinary plastic material may be used as a material for the tubular net 2. Examples of the material include polyethylene, polypropylene, polyvinyl chloride, polyvinylidene chloride, polyester, polyvinyl acetate and nylon. A foam of any of these materials is also usable. The line diameter of the net is desirably not greater than 5 mm in consideration of the fact that the packing filler is used for packing the solid pieces in a small-size package container. It is practically preferred that apertures of the net each have an edge length of not greater than 20 mm. The solid pieces are unlikely to pass through the apertures, because the packing filler is compressed in the package container. The shape of each of the apertures is not limited to a rhombic shape, but may be a square, rectangular, triangular, hexagonal or round shape.

Figure 4:
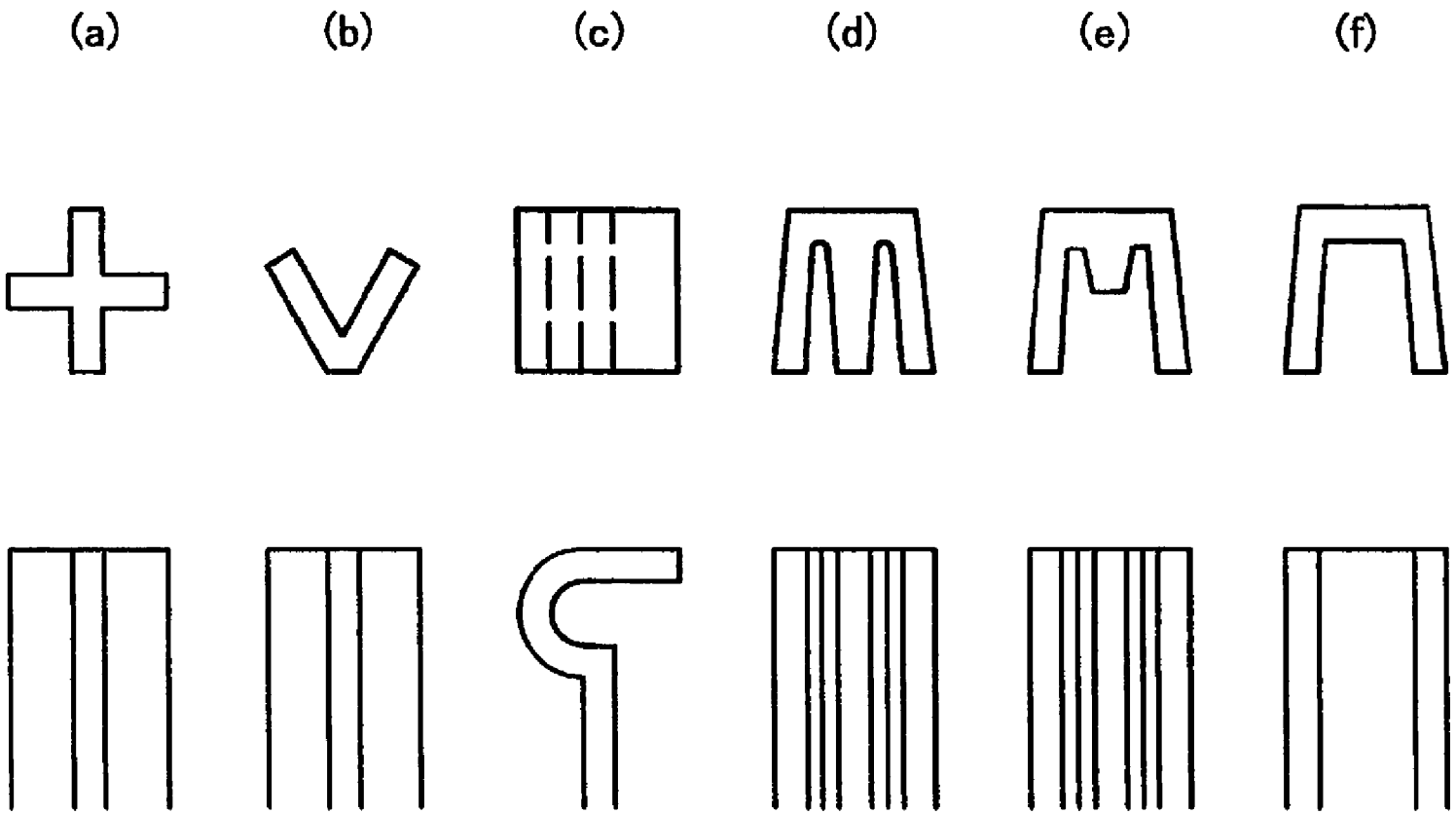
FIG. 4 is plan views (on an upper side) and front views (on a lower side), illustrating modifications (a) to (f) of a holder portion of the packing filler.
Figure 5:
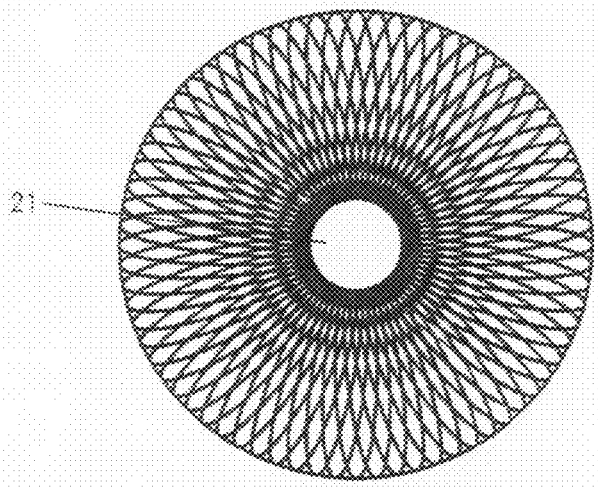
FIG. 5 is a plan view of a prior-art packing filler.
Figure 6:
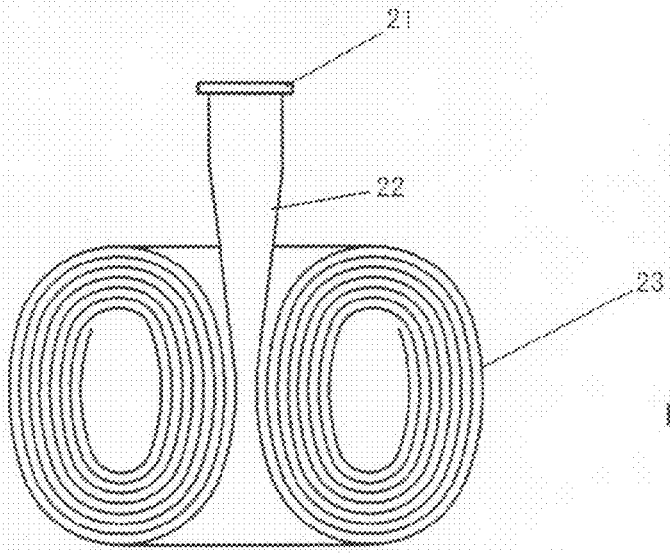
PRIOR ART Fig. 6
FIG. 6 is a vertical sectional view of the prior-art packing filler.
Figure 7:
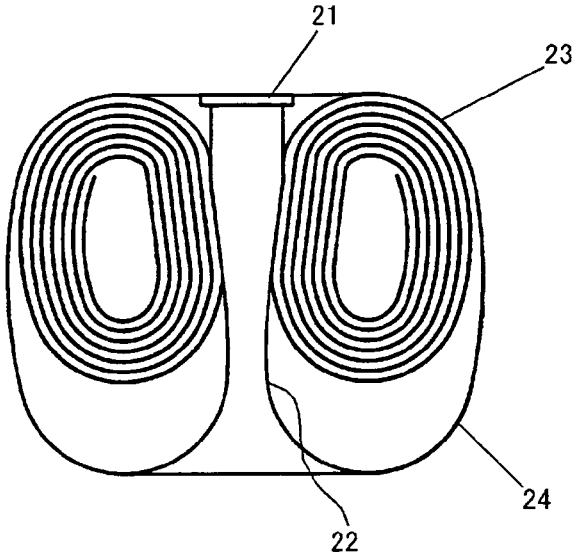
FIG. 7 is a vertical sectional view of the prior-art packing filler in use.

The present invention is not limited to the aforementioned embodiment, but modifications may be made to the embodiment. For example, the holder portion may have a noncircular shape such as those shown in FIG. 4. According to these modifications, the upper end face of the holder portion is brought into face contact with the ceiling surface of the cap and, therefore, the holder portion is less liable to topple when being depressed by the cap.

The invention claimed is:

1. A container packing filler, comprising:

an annular roll portion formed by folding one of axially opposite end portions of a stretchable tubular net radially outward and rolling the net toward the other end portion of the net; and a rigid holder portion provided at the other end portion of the net to be squeezed into a center hole of the annular roll portion, wherein the holder portion has a maximum width which is greater than a diameter of the center hole of the annular roll portion, wherein the annular roll portion and rigid holder portion each has a top and with the top of the rigid holder portion situated axially to be flush with the top of the roll portion, the rigid holder portion is squeezed into the center hole, wherein with the top of the rigid holder portion flush with the top of the roll portion, the rigid holder portion has a sufficient axial length that the rigid holder portion squeezes the top of the annular roll portion radially outwardly.

2. A container packing filler as set forth in claim 1, wherein the holder portion is a part of the other end portion of the net bound by fusion-bonding as having a predetermined axial length.

3. A container packing filler as set forth in claim 1, wherein the holder portion has a noncircular cross section as seen axially.

4. A container packing filler as set forth in claim 1, wherein the maximum width of the holder portion is 1.5 to 3 times the diameter of the center hole of the annular roll portion.

5. A container packing filler as set forth in claim 1, wherein the annular roll portion comprises a plurality of layers and with the rigid holder portion squeezed into the center hole a plurality of the layers are bulged radially inwardly to narrow the diameter of the center hole.

6. The container packing filler as set forth in claim 1, wherein the plurality of the layers are bulged radially inwardly below the rigid holder portion to narrow the diameter of the center hole.

7. The container packing filler as set forth in claim 1 wherein the annular roll portion has an axial length and the rigid holder portion has an axial length equal to approximately one half the axial length of the annular roll portion.

* * * * *